United States Patent [19]

Baxter et al.

[11] Patent Number: 4,734,997

[45] Date of Patent: Apr. 5, 1988

[54] METHOD AND APPARATUS FOR DRYING FILAMENTARY MATERIAL

[75] Inventors: Gordon D. Baxter; James C. Grant; John N. Garner, all of Kingston, Canada

[73] Assignee: Northern Telecom Limited, Montreal, Canada

[21] Appl. No.: 4,517

[22] Filed: Jan. 20, 1987

[51] Int. Cl.[4] ..... F26B 3/04

[52] U.S. Cl. ..... 34/23; 34/33; 34/155; 34/159; 28/272; 28/280

[58] Field of Search ..... 34/22, 23, 33, 152, 34/155, 159, 163; 28/272; 57/280, 284, 290

[56] References Cited

U.S. PATENT DOCUMENTS

| | | | |
|---|---|---|---|
| 2,325,950 | 8/1943 | Greene et al. | 34/155 |
| 2,351,549 | 6/1944 | Schwartz | 34/23 |
| 2,509,279 | 5/1950 | Sisson | 34/155 |
| 3,367,100 | 2/1968 | Hughey | 28/272 |
| 3,701,182 | 10/1972 | Gasser et al. | 34/23 |
| 3,905,185 | 9/1975 | Bauer et al. | 34/152 |
| 4,633,550 | 1/1987 | McAliley et al. | 28/272 |

*Primary Examiner*—L. I. Schwartz
*Attorney, Agent, or Firm*—R. J. Austin

[57] ABSTRACT

In a method and apparatus for drying filamentary material, a duct is provided for enclosing a portion of a passline. The duct comprises two parts relatively disposed laterally of the passline. These parts are relatively movable away from one another laterally of the passline to provide a duct open position and towards one another to provide a duct closed postion. First and second guide wheels are provided for guiding the filamentary material along the passline through the duct. The guide wheels are relatively movable along the passline between the duct parts in the duct open position between a first pair of relatively close positions and a second pair of positions at opposite ends of the duct. With the duct in the duct open position and the guide wheels in the first pair of positions, filamentary material is fed over the guide wheels. The guide wheels are moved relatively along the passline from the first pair of positions to the second pair of positions to draw the filamentary material along the passline between the duct parts. The duct parts are moved into the duct closed position to enclose the filamentary material extending between the guide wheels. A drying gas is passed into the duct while advancing the filamentary material along the passline and guiding it through the duct. The method and apparatus are useful for drying solvent-based colorants on polymer-insulated wire.

4 Claims, 5 Drawing Sheets

FIG. I

METHOD AND APPARATUS FOR DRYING FILAMENTARY MATERIAL

The invention relates to a method and apparatus for drying filamentary material.

Conventional apparatus for drying filamentary material, such as PVC-insulated wire carrying a wet solvent-based colourant, comprises a vertical duct, guide wheels at either end of the duct and hot air guns communicating with the interior of the duct. The wire is passed along the duct from one guide wheel to the other, while hot air is blown into the duct to evaporate the solvent, thereby drying the colourant on the wire.

Because the duct may be several feet long, it is difficult to feed the wire up the duct and over the upper guide wheels to prepare the apparatus for the drying operation.

The present invention seeks to provide a method and apparatus for drying filamentary material in use of which the above problem is mitigated.

Accordingly, one aspect of the invention provides a method for drying filamentary material as it is advanced along a passline, comprising: providing duct means for enclosing a portion of the passline, the duct means comprising two parts relatively disposed laterally of the passline, said parts being relatively movable away from one another laterally of the passline to provide a duct open position, and towards one another to provide a duct closed position, and first and second guide means for guiding the filamentary material along said portion of the passline through the duct means, the guide means being relatively movable along said portion of the passline between the parts of the duct means in the duct open position between a first pair of relatively close positions and a second pair of positions at opposite ends of the duct means; in the duct open position and with the guide means in the first pair of positions, feeding the filamentary material in relation to the guide means to cause the guide means to guide the filamentary material; relatively moving the guide means along the passline from the first pair of positions to the second pair of positions to draw the filamentary material along the passline between the parts of the duct means in the duct open position; moving the parts of the duct means into the duct closed position to enclose filamentary material extending between the guide means; and passing a drying gas into the duct means while advancing the filamentary material along the passline and guiding it through the duct means.

Another aspect of the invention provides apparatus for drying filamentary material as it is advanced along a passline, comprising: duct means for enclosing a portion of the passline comprising two parts relatively disposed laterally of the passline, said parts being relatively movable away from one another laterally of the passline to provide a duct open position and towards one another to provide a duct closed position; first and second guide means located on the passline for guiding the filamentary material along the portion of the passline through the duct means, the guide means being relatively movable along said portion of the passline between the parts of the duct means in the duct open position between a first pair of relatively close positions and a second pair of positions at opposite ends of the duct means; and means for directing a drying gas into the duct means in the duct closed position.

The method and apparatus according to the invention simplify feeding of the filamentary material through the duct means. The duct means is constructed to be movable between a duct open feeding position and a duct closed operating position. In the duct open position, the guide means can be located in a pair of relatively close positions for ease of feeding the filamentary material in relation to the guide means. The guide means can then be moved to a second pair of positions at opposite ends of the duct means, drawing the filamentary material along the passline between parts of the duct means. The duct parts are then moved towards one another into the duct closed position for the filament drying operation.

An embodiment of the invention will now be described by way of example only, with reference to the accompanying drawings, in which.

Figure 1:
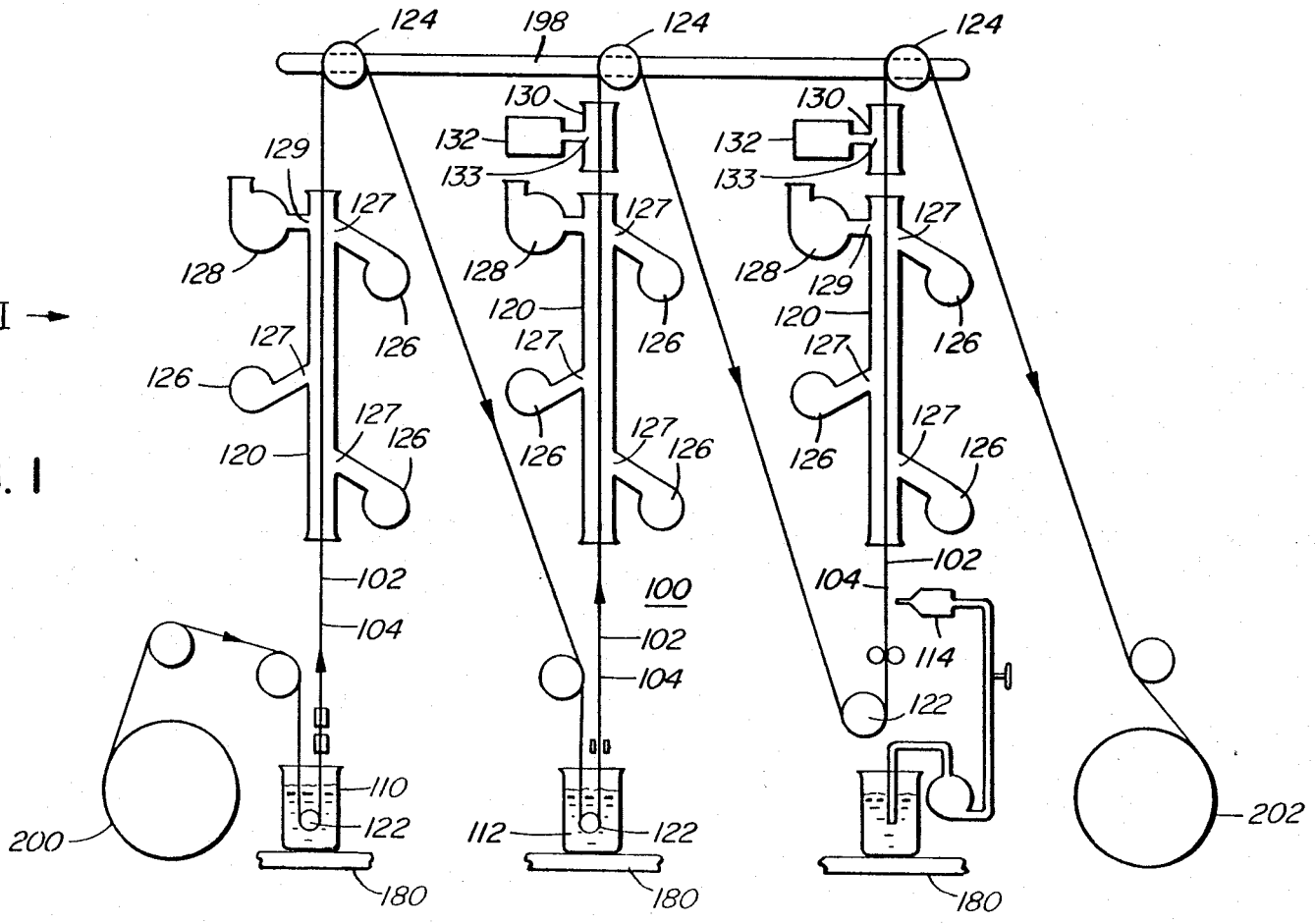
FIG. 1 is a schematic cross-sectional view of apparatus according to the embodiment for colouring and drying PVC-insulated wire.

In the embodiment, apparatus 100 is provided for cleaning existing colouring from filamentary material in the form of PVC-insulated wire 102 and for recolouring it. The apparatus 100 will first be described briefly with reference to FIG. 1.

The apparatus 100 includes a solvent reservoir 110 through which the PVC-insulated wire is advanced along a passline 104 to clean and prepare the surface of the wire, a colourant reservoir 112 through which the wire is advanced to colour it uniformly, and a spray head 114 past which the wire is advanced while intermittently spraying colourant onto the wire to apply bands of colour to the wire. After each of these successive operations it is essential to dry the wire 102 before it passes on to the next operation.

For this purpose, the apparatus 100 comprises three vertical duct means, each in the form of a vertical hot air duct 120. The three ducts 120 enclose three vertical portions of the passline 104, a first of the vertical portions being immediately downstream of the solvent reservoir 110, a second portion being immediately downstream of the colourant reservoir 112, and a third portion being immediately downstream of the spray head 114. Each hot air duct 120 has associated first and second guide means in the form of lower and upper guide wheels 122, 124 respectively, located on the passline 104 for guiding the wire 102 along the passline through its duct.

The apparatus 100 further comprises means for directing drying gas into each hot air duct 120 to dry the wire 102 as it is advanced along the passline 104 through that duct. In particular, hot air guns 126 are arranged to blow hot air into each hot air duct 120 through openings 127 in the duct. A hot air exhaust fan 128 is connected near the top of each hot air duct 120.

The hot air ducts 120 downstream of the colourant reservoir 112 and the spray head 114 are each surmounted by an in-line vertical cold air duct 130. A refrigeration device 132 is provided for directing cold air into the duct 130. The provision of cold air at these locations is the subject of a copending patent application Ser. No. 004,518, filed Jan. 20, 1987 and entitled "Method and Apparatus for Colouring Polymer-Insulted Wire" in the names of G. D. Baxter, J. C. Grant and J. N. Garner, and now U.S. Pat. No. 4,708,887, issued Nov. 24, 1987.

Each of the vertical hot air ducts 120 is several feet long. Hence it would be difficult to feed the wire 102 through the hot and cold air ducts 120, 130 and over the upper guide wheels 124 to prepare the apparatus for operation. In order to simplify feeding of the wire 102 through the ducts 120, 130, the apparatus 100 is constructed as shown in FIGS. 2, 3, 4 and 5 and as described in more detail below with reference to these figures. Note that parts of the apparatus 100, including the reservoirs 110, 112, spray head 114, hot air guns 126, exhaust fans 128 and refrigeration devices 132, have been removed in these views to simplify the figures.

As shown in FIGS. 2, 3, 4 and 5, the apparatus 100 comprises a fixed vertical frame 140 which is secured to a horizontal frame base 180. A vertical frame 142 is slidably mounted on the base 180 so as to be movable horizontally towards and away from the fixed frame 140. A threaded shaft 144 rotatably mounted through the fixed frame 140 engages a threaded bore 146 in the slidable frame 142, so that rotation of the threaded shaft by means of a handle 148 drives the slidable frame into sliding motion on the base 180. An unthreaded shaft 150 parallel to the threaded shaft 144 is fixed to the fixed frame 140 and slidably received in an unthreaded bore 152 of the slidable frame 142 to maintain proper alignment of the slidable frame with respect to the fixed frame as the slidable frame is moved on the base 180.

Figure 2:
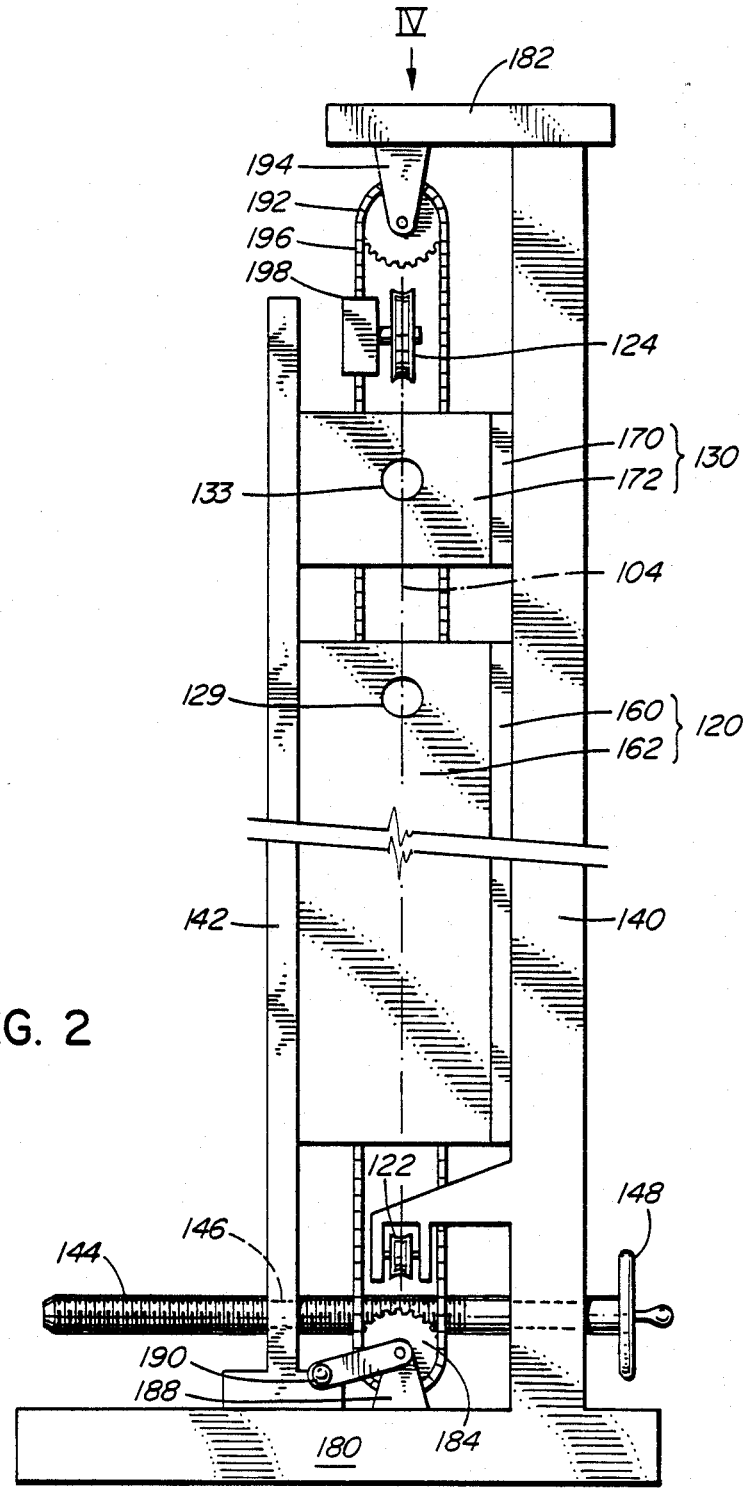
FIG. 2 is a side elevational view in the direction of arrow II in FIG. 1 of parts of the apparatus of FIG. 1, showing duct means in duct closed positions.
Figure 3:
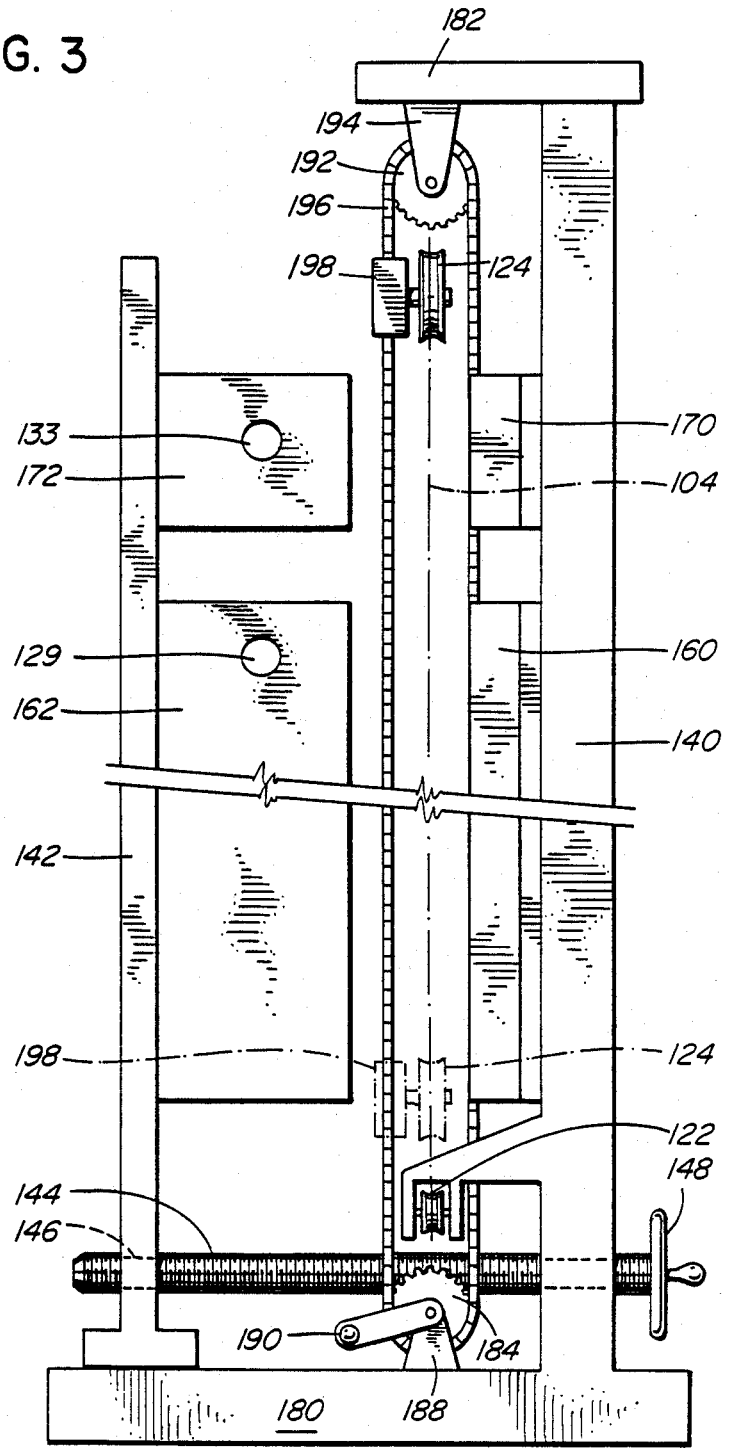
FIG. 3 is a view similar to FIG. 2 showing the duct means of FIG. 1 in open positions.
Figure 4:
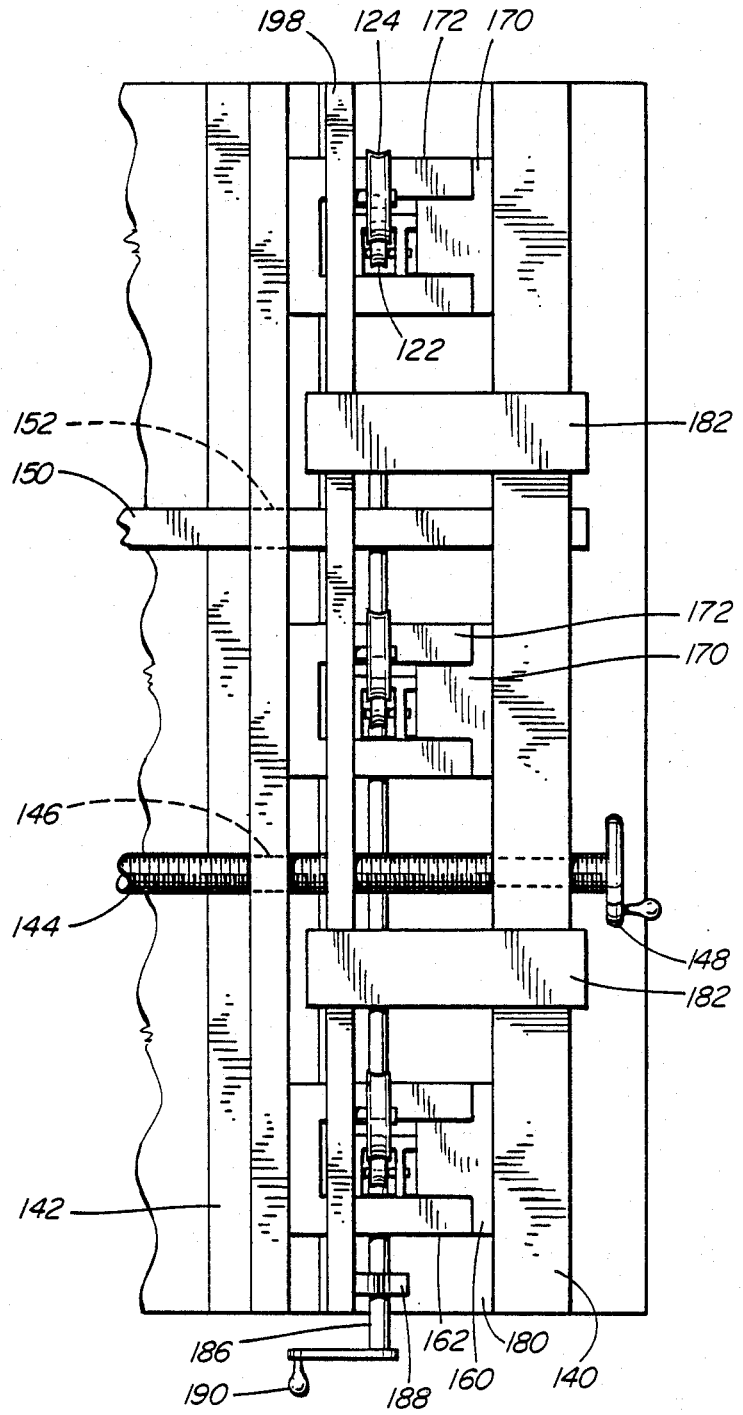
FIG. 4 is a plan view of the apparatus in the direction of arrow IV in FIG. 2 showing the duct means in the closed positions.
Figure 5:
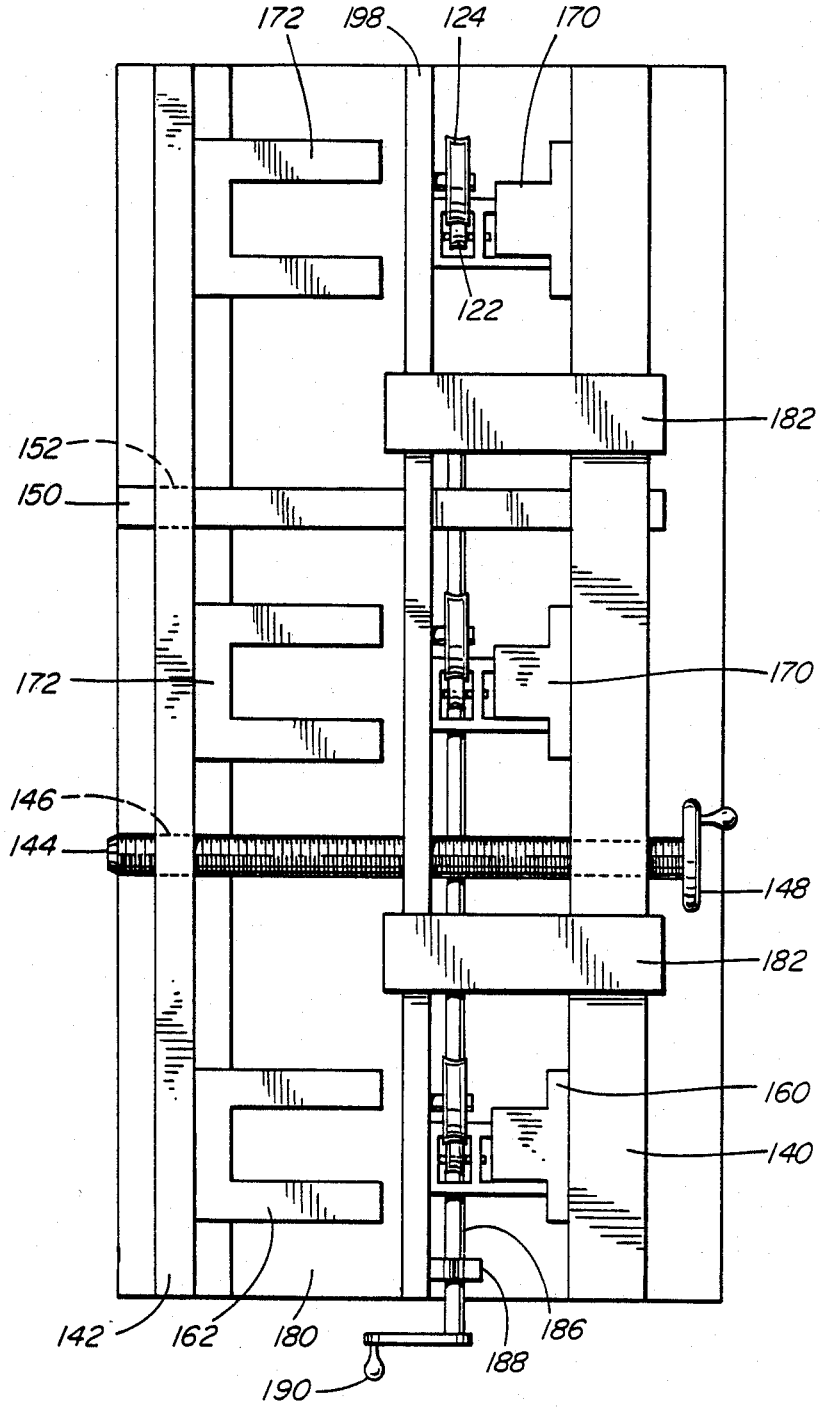
FIG. 5 is a view similar to FIG. 4 showing the duct means in open positions.

Each hot air duct 120 comprises a fixed part 160 mounted to the fixed frame 140 and a movable part 162 mounted to the slidable frame 142. The two parts 160, 162 are relatively disposed laterally of the vertical portion of the passline 104 which passes through each duct 120. The movable part 162 is movable between a position closely adjacent the fixed part 160 to provide a duct closed position, as shown in FIGS. 2 and 4, and a position spaced apart from the fixed part to provide a duct open position, as shown in FIGS. 3 and 5. The movement of the movable part 162 is effected by rotation of the threaded shaft 144 which drives the slidable frame 142 as described above.

Similarly, each cold air duct 130 comprises a fixed part 170 mounted to the fixed frame 140 and a movable part 172 mounted to the slidable frame 142. Movement of the cold air duct parts 170, 172 corresponds to movement of the hot air duct parts 160, 162.

The fixed frame 140 includes a pair of parallel horizontal cross-pieces 182 which extend over the base 180 at the upper end of the fixed frame 140. Means is provided for moving the three upper guide wheels 124 vertically and in unison. This means comprises two upper chain wheels 192 rotatably mounted to brackets 194 depending one from each of the cross pieces 182, each above a corresponding lower chain wheel 184. The lower chain wheels 184 are mounted to a common horizontal shaft 186 which is rotatably mounted to brackets 188 on the base 180. (Only one bracket 188 is shown, the other bracket being obscured by one of the cross pieces 182 in FIGS. 4 and 5.) A handle 190 is provided for manual rotation of the common shaft 186, and a locking mechanism (not shown) is provided for locking the common shaft against rotation. Drive chains 196 extend between and drivably connect corresponding upper and lower chain wheels 184, 192. A horizontal beam 198 is fixed to the drive chains 196, so that rotation of the common shaft 186 causes vertical movement of the beam. The beam 198 is spaced horizontally apart from the fixed parts 160, 170 of the hot and cold air ducts 120, 130 such that, when the movable parts 162, 172 of the ducts are in their open positions, the beam may pass vertically between the fixed and movable parts of the ducts.

Each lower guide wheel 122 is rotatably mounted to the fixed frame 140 on the passline 104. Each upper guide wheel 124 is rotatably mounted to the cross beam 198 on the passline 104 above a corresponding lower guide wheel 122. Thus, each upper guide wheel 124 is vertically movable, in the duct open position, between a position on the passline 104 adjacent the corresponding lower guide wheel 122 and a position on the passline at the opposite end of the corresponding duct 120 from the corresponding lower guide wheel 122 by vertical movement of the beam 198 between separated parts 160, 162 of the duct.

In use of the apparatus 100, the fixed parts 160, 170 and movable parts 162, 172 of the hot and cold air ducts 120, 130 are put in the duct open position, as shown in FIGS. 3 and 5. The upper and lower guide wheels 122, 124 are put into relatively close positions as shown in phantom outline in FIG. 5. The wire 102 is threaded from an unreeler 200 over the upper and lower guide wheels 122, 124 and connected to a reeler 202 at the other end of the apparatus 100. The upper guide wheels 124 are then moved along the passline 104 to their upper positions (as shown in full outline in FIG. 5) by raising the beam 198 between the duct parts 160, 162, 170, 172. As the wire 102 extends over the upper guide wheels 124, the upward movement of the upper guide wheels draws the wire along the vertical portions of the passline 104 between the separated duct parts 160 162, 170, 172. The beam 198 is locked in its raised position by operation of the locking means acting on the chain drive mechanism 184, 186, 190, 192, 196. The separated duct parts 160, 162, 170, 172 are brought together into the duct closed position shown in FIG. 3 to enclose the wire 102 as it extends along the vertical portions of the passline 104 i.e. between pairs of upper and lower guide wheels 122, 124. The wire 102 then follows the passline 104 shown schematically in FIG. 1. After the reservoirs 110, 112 have been filled and located as shown in FIG. 1, the apparatus 100 may now be operated to clean, colour and dry the wire 102 as described in the copending application referred to above. From the above description, it can be seen that feeding the wire 102 through the ducts 120, 130 is a relatively simple procedure.

In modifications of the apparatus, alternative drive means could be provided for separating the duct parts 160, 162, 170, 172 and for raising and lowering the upper guide wheels 124. Motors, pneumatic or hydraulic apparatus could be provided for powering these drive means.

Means for moving both sets of guide wheels along the passline to adjacent accessible positions could also be provided in modifications of the apparatus.

What is claimed is:

1. A method for drying filamentary material as it is advanced along a passline, comprising:

providing duct means for enclosing a portion of the passline, the duct means comprising two parts relatively disposed laterally of the passline, said parts being relatively movable away from one another laterally of the passline to provide a duct open position, and towards one another to provide a duct closed position, and first and second guide means for guiding the filamentary material along said portion of the passline through the duct means, the guide means being relatively movable along said portion of the passline between the parts of the duct means in the duct open position between a first pair of relatively close positions and a second pair of positions at opposite ends of the duct means; and in the duct open position and with the guide means in the first pair of positions, feeding the filamentary material in relation to the guide means to cause the guide means to guide the filamentary material;

relatively moving the guide means along the passline from the first pair of positions to the second pair of positions to draw the filamentary material along the passline between the parts of the duct means in the duct open position;

moving the parts of the duct means into the duct closed position to enclose filamentary material extending between the guide means; and passing a drying gas into the duct means while advancing the filamentary material along the passline and guiding it through the duct means.

2. Apparatus for drying filamentary material as it is advanced along a passline, comprising:

duct means for enclosing a portion of the passline comprising two parts relatively disposed laterally of the passline, said parts being relatively movable away from one another laterally of the passline to provide a duct open position and towards one another to provide a duct closed position;

first and second guide means located on the passline for guiding the filamentary material along the portion of the passline through the duct means, the guide means being relatively movable along said portion of the passline between the parts of the duct means in the duct open position between a first pair of relatively close positions and a second pair of positions at opposite ends of the duct means; and means for directing a drying gas into the duct means in the duct closed position.

3. Apparatus as defined in claim 2, wherein, with the first guide means at one end of the duct means, the second guide means is movable along said portion of the passline in the duct open position between a first position adjacent the first guide means and a second position at an opposite end of the duct means.

4. Apparatus as defined in claim 2, further comprising:

fixed frame means carrying one of the two duct parts, the first and second guide means, and means for relatively moving the first and second guide means on the fixed frame between their first and second pairs of positions;

movable frame means carrying the other of the two duct parts; and means for moving the movable frame means laterally of the passline away from the fixed frame to open the duct means, and toward the fixed frame to close the duct means.

* * * * *